US007318630B2

(12) United States Patent
Landsberger et al.

(10) Patent No.: US 7,318,630 B2
(45) Date of Patent: Jan. 15, 2008

(54) MODULAR LABORATORY CABINET

(75) Inventors: David Landsberger, Caldwell, NJ (US); Paul Thom, Butler, NJ (US); Francis Gomes, Jersey City, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 396 days.

(21) Appl. No.: 11/024,209

(22) Filed: Dec. 27, 2004

(65) Prior Publication Data

US 2005/0104484 A1 May 19, 2005

Related U.S. Application Data

(63) Continuation-in-part of application No. 10/075,262, filed on Feb. 15, 2002, now Pat. No. 6,834,920.

(60) Provisional application No. 60/273,871, filed on Mar. 7, 2001.

(51) Int. Cl.
*A47B 43/00* (2006.01)

(52) U.S. Cl. ..... 312/111; 312/257.1

(58) Field of Classification Search ..... 312/263, 312/257.1, 209, 223.1, 107, 108, 111
See application file for complete search history.

(56) References Cited

U.S. PATENT DOCUMENTS

| | | | | |
|---|---|---|---|---|
| 799,104 | A | 9/1905 | Sprague | |
| 835,508 | A | 11/1906 | Faust et al. | |
| 892,187 | A * | 6/1908 | Schriefer | 312/107 |
| 2,506,844 | A | 5/1950 | Smith | |
| 2,568,592 | A | 9/1951 | O'Connor | |
| 3,305,287 | A | 2/1967 | Rait | |
| 3,584,744 | A | 6/1971 | Ettlinger, Jr. | |
| 3,666,340 | A | 5/1972 | Albeanese, III | |
| 3,741,404 | A | 6/1973 | Jourdain | |
| 4,023,871 | A * | 5/1977 | Dantzler | 312/107 |
| 4,217,012 | A * | 8/1980 | Klaus | 312/292 |
| 4,226,488 | A | 10/1980 | Vincent | |
| 4,277,120 | A | 7/1981 | Drake et al. | |
| 4,288,136 | A | 9/1981 | Le Mer | |
| 4,322,118 | A * | 3/1982 | Shugart | 312/111 |
| 4,413,867 | A | 11/1983 | Mosebrook et al. | |
| 4,453,789 | A | 6/1984 | Gullong | |
| 4,474,416 | A | 10/1984 | Rogahn | |
| 5,044,595 | A * | 9/1991 | Carr et al. | 248/460 |
| 5,142,445 | A * | 8/1992 | Sorensen et al. | 361/726 |

(Continued)

FOREIGN PATENT DOCUMENTS

DE 2329016 A 1/1975

OTHER PUBLICATIONS

Terra Universal, Inc. catalog, pp. 107, 112, 116, 118, 128, 129, 143, 144 and 151 Bel-Art Products, Inc. catalog 198, pp. 98-112, 1998, undated.

*Primary Examiner*—Janet M. Wilkens
(74) *Attorney, Agent, or Firm*—Lawrence G. Fridman

(57) ABSTRACT

A modular laboratory cabinet assembly consists of a pair of identical housing end units arranged in an inverted spaced apart relations to each other, and at least a pair of identical base housing modules arranged in an inverted side by side relations to each other and interposed between the housing end units.

17 Claims, 19 Drawing Sheets

U.S. PATENT DOCUMENTS 5,305,187 A 4/1994 Umezu et al.
5,810,459 A 9/1998 Barrett et al.
5,839,806 A 11/1998 Liu
5,926,916 A 7/1999 Lee et al.
5,975,660 A 11/1999 Tisbo et al.
6,099,092 A 8/2000 Uffner et al.
6,193,340 B1 2/2001 Schenker et al.
6,834,920 B2 * 12/2004 Landsberger et al. .... 312/257.1
7,116,553 B2 * 10/2006 Bleau et al. ..... 361/690
7,134,673 B2 * 11/2006 Ferraro et al. ..... 280/33.991
2005/0110371 A1 * 5/2005 Li ..... 312/108

* cited by examiner

MODULAR LABORATORY CABINET

This non-provisional application is a Continuation-in-Part Application of U.S. patent application Ser. No. 10/075,262 filed Feb. 15, 2002, currently U.S. Pat. No. 6,834,920, which claims benefit under 35 USC 119(e) of U.S. provisional application Ser. No. 60/273,871 filed by David Landsberger, Paul Thorn and Francis Gomes on Mar. 7, 2001.

BACKGROUND OF THE INVENTION

1. Field of the Invention

The present invention relates generally to a laboratory equipment and, more particularly, to a modular laboratory cabinet assembly enabling an end user to tailor the cabinet holding capacity and the cabinet orientation on a supporting surface.

2. Description of the Prior Art

Cabinets are commonly used in laboratories to accommodate various types of laboratory related equipment, as well as to accommodate products, materials, substances and the like during processing and testing. For many laboratory related applications it is desirable, or even necessary, to use such device having an airtight construction and/or means for minimizing the relative humidity level within the cabinet. Such laboratory cabinets are commercially available and well known in the prior art. Conventionally, the aforementioned storage devices adapted for laboratory use are offered pre-assembled in a limited number of fixed sizes and geometric configuration.

For a variety of reasons, the required or desired cabinet space can vary over time. For instance, it may be desirable to increase or decrease the size of a cabinet due to changes in the testing or processing requirements as well as overall laboratory space availability. Furthermore, it may be desirable to alter the size of a cabinet in light of changes in the volume of equipment, products, materials and substances requiring such storage. Furthermore, fixed size laboratory cabinets are quite bulky, as a result, their shipment and storage can be cumbersome and expensive. Consequently, it is well known that there are inherent inefficiencies associated with fixed size laboratory cabinets.

Modular storage devices and cabinets are known in the prior art. However, these known storage devices generally suffer from one or more drawbacks and limitations which render them undesirable for the aforementioned laboratory applications. For instance, U.S. Pat. No. 5,810,459 discloses a stackable modular cabinet having modular, interlocking side units allowing cabinet dimensions to be tailored both vertically and laterally to user needs. However, the modular cabinet design disclosed in the '459 patent does not provide an airtight compartment. Furthermore, the design requirements of the particular application, i.e., holding heavy electrical equipment, result in a storage unit having a relatively complex structure incorporating numerous individual components and necessitating at least some prefabrication prior to shipment to an end user. Moreover, the disclosed cabinet has a metal construction that is undesirable for many laboratory applications including, for example, storage of certain chemicals. U.S. Pat. Nos. 4,277,120; 5,305,187; 5,839,806 and 6,193,340 are exemplary of other types of known modular storage devices. However, these disclosed exemplary devices suffer from one or more of the aforementioned drawbacks and limitations, rendering them inconvenient/unacceptable for use for various laboratory applications.

Accordingly, there is a well-established need for a modular storage container assembly adapted for accommodating various requirements of different types of laboratories. In particular, it would be desirable to provide a modular storage container assembly having an airtight construction, capable of incorporating humidity control apparatus, and incorporating a simplified design lending itself to cost-effective manufacture and enabling an end user to customize the holding capacity. Furthermore, it would be desirable to provide such a modular construction having an inherently simple design enabling such custom configuration at a laboratory location in a relatively simple, quick and efficient manner without special skills or special tools.

SUMMARY OF THE INVENTION

The invention is directed to a modular cabinet assembly particularly adapted for accommodating various laboratory applications, wherein the cabinet has a simple configuration facilitating adjustment of the holding capacity and orientation by an end user.

In one general aspect of the present invention a modular cabinet assembly is provided comprising: a pair of housing end units arranged in an inverted spaced apart relation to each other. Each housing end unit has a base bounded by front, rear, first and second sides terminating at a common peripheral edge separating interior and exterior surfaces of the end unit. The peripheral edge has a recessed segment extending along the front side. A plurality of elongated supporting members with apertures passing therethrough are provided at each housing end unit.

At least a pair of base module units arranged in an inverted side by side relations to each other and interposed between the housing end units. Each base module has a respective rear side, a first side, a second side, and a front side portion. The sides of the base module terminate at an engaging peripheral edge thereof. The engaging peripheral edge of each base module has a recessed area extending along the front side thereof.

At least one intermediate housing module end is interposed between each housing end unit and the respective base module. Each intermediate module is formed with at least a pair of spaced apart from each other front side portions. The recessed segment of each unitary housing end unit, the spaced apart front side portions of the at least one intermediate housing module and the recessed area of the respective base module form a continuous opening adapted to accommodate a respective door.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention is generally directed to an insulated modular cabinet assembly adapted for use in various laboratory environments. The assembly incorporates a simple and flexible stackable modular design lending itself to effortless on-site assembly and customization by an end user.

Figure 1:
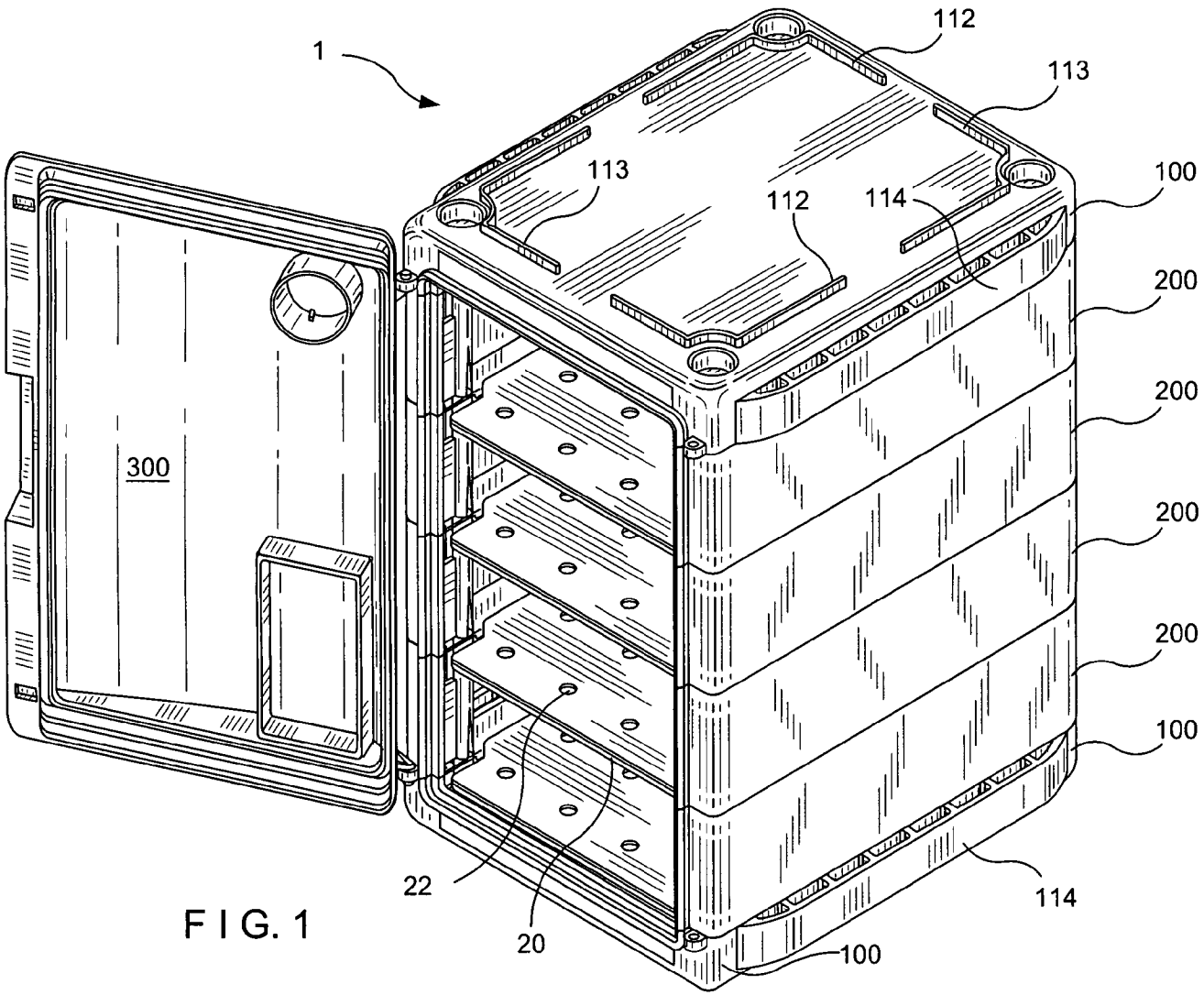
FIG. 1 is perspective view of a fully assembled, vertically oriented cabinet assembly incorporating four intermediate cabinet module and having removable cabinet shelves, in accordance with the present invention.

Referring initially to FIG. 1, a preferred embodiment of the modular cabinet assembly 1 of the present invention is illustrated in a fully assembled state. The modular cabinet assembly 1 generally includes a housing subassembly comprised of one or more stackable modules 200 interposed between a pair of identical opposing housing end units 100, and a cabinet door 300 hingedly connected to the front of the housing end units 100. As will be described in more detail below, the housing end units 100 and interposed stackable modules 200 are securely fastened to one another using fastening components, sealing gaskets and the like, such that in a completely assembled state with the door 300 in a closed position the cabinet assembly provides an airtight enclosure.

Referring now to FIGS. 1-17, the particular structural features and arrangement of the individual components of the modular cabinet assembly of the present invention will be described in more detail.

As best illustrated in FIGS. 8-11, the housing end units 100 have a unitary construction and are each generally defined by base 102, front 104, rear 106, first 108 and second 110 sides. The base 102 is further defined by outer surface 103 and interior surface 105. The front, rear, first and second sides share a peripheral edge 129. As should be readily apparent from the accompanying drawing figures, although the upper and lower housing end units are identical in structure, in the assembled state the lower end unit has an inverted orientation with respect to the upper end unit and vise versa. Consequently, with the cabinet housing subassembly being vertically oriented, as depicted throughout the accompanying drawings, for example in FIG. 2, first side 108 of lower housing end unit 100 is actually positioned along the rightmost side of the cabinet assembly, second side 110 along the leftmost side of the cabinet assembly, and so forth.

Figure 8:
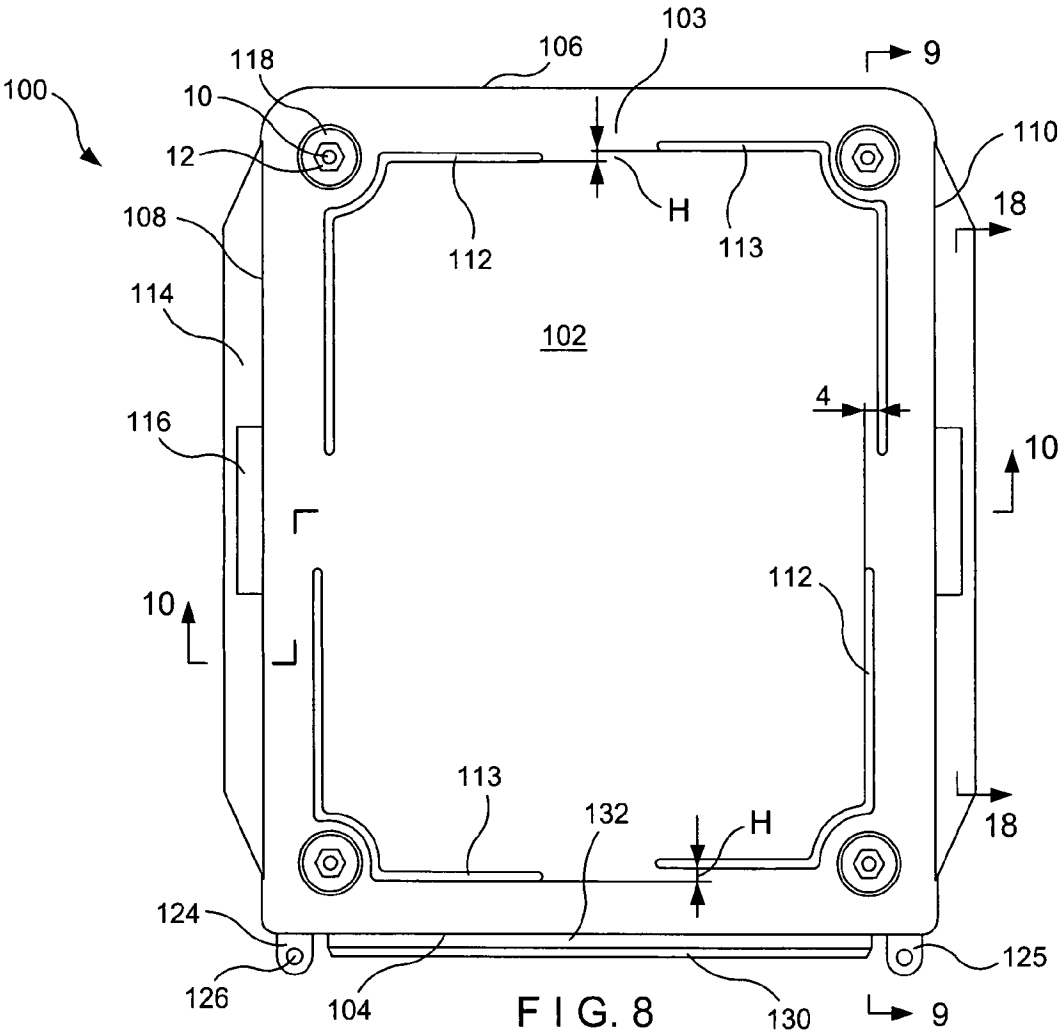
FIG. 8 is a top plan view of the exterior surface of housing end unit.
Figure 10:
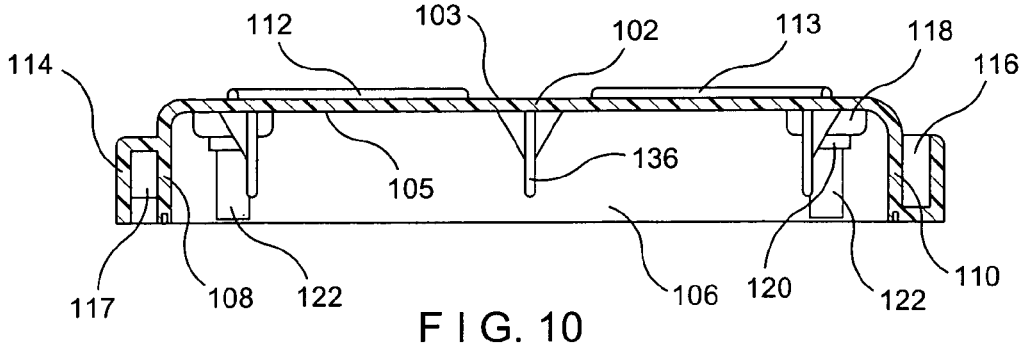
FIG. 10 is a cross-sectional view taken along section plane 10-10 in FIGS. 8 and 11.

Referring particularly to the upper housing end unit 100, best illustrated in FIGS. 8-11, for convenience, the base 102 has two sets of peripherally disposed integral raised engaging segments 112, 113 protruding from its outer surface 103. Each set consists of two diagonally opposed pairs of segments, wherein in each pair the segments are substantially perpendicular to each other. The first set of segments 112 is disposed on the surface 103 slightly peripherally inward with respect to the second set of segments 113. In other words, segments 112 are slightly peripherally inset vis-à-vis segments 113. As illustrated in FIG. 8, the segments 112 are inwardly shifted at the distance "H" relative to the respective segment 113. The segments 112, 113 are provided to impart stability, when two or more of the modular cabinet assemblies of the present invention are vertically stacked. More specifically, in the stacked cabinet arrangement inset segments 112 protruding upwardly from a lower one of the cabinet modules will frictionally engage the corresponding segments 113 downwardly protruding from an upper one of the cabinet modules. Likewise, slightly inset segments 112 protruding downwardly from the top cabinet will frictionally engage the corresponding segments 113 upwardly protruding from the bottom cabinet. The corresponding segments 112, 113 prevent undesirable sliding between the contacting surfaces 103 of the stacked cabinets.

As illustrated in FIGS. 8-11 and 18, ribs 114 extend longitudinally along the outer surfaces of first and second sides 108 and 110. Each rib 114 has finger-receiving recesses 116 and 117 oriented in opposite directions and formed therein to facilitate carrying or other manual manipulation of the cabinet assembly by providing improved gripping. The recess 116 is centrally positioned between two recesses 117 oriented in the opposite direction. Each recess is formed between the rib 114 and respective sides 108, 110 of the housing 100.

Each end unit 100 is formed with four integral longitudinal formations or supporting members 122 situated in each respective corner thereof and extending outwardly from the base 102. Longitudinal guiding apertures 135 pass through the entire length of the respective supporting members 122. It will be discussed in greater detail below that the guiding apertures 135 in combination with other elements of the invention are adapted to receive fastening elements or connecting members keeping the assembly together.

Figure 20:
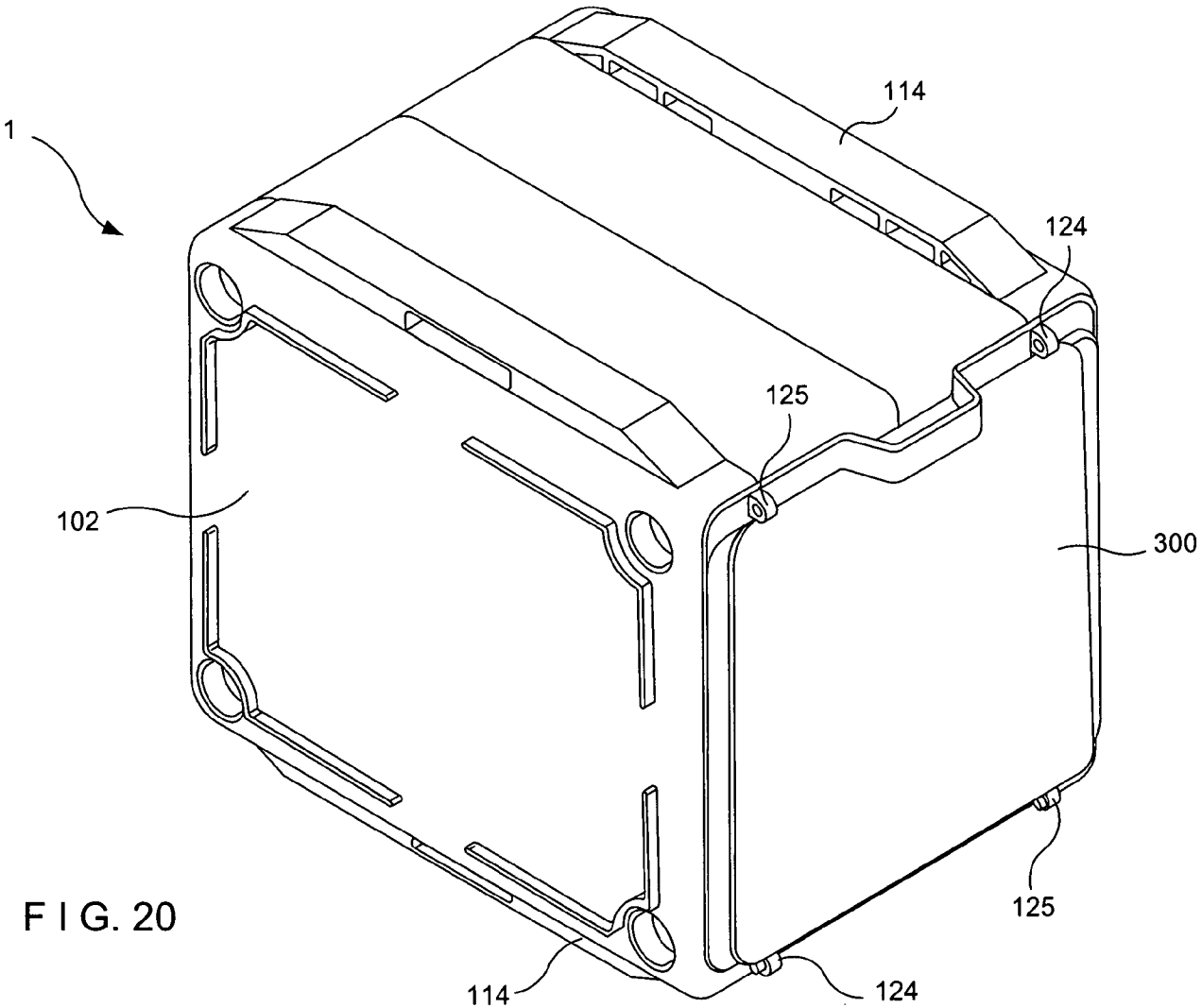
FIG. 20 is a perspective view of a horizontally oriented modular cabinet assembly of FIG. 4.

In FIGS. 1-4 and 16,17 the modular cabinet assembly is illustrated in a vertical orientation; that is, an orientation wherein the modular cabinet assembly is oriented with bases 102 of the end units 100 being substantially parallel to the supporting surface. FIG. 20 shows that the modular cabinet of assembly 1 of the present invention can also be maintained in a substantially horizontal orientation, wherein the entire assembly is rotated 90° to the left or right. In this substantially horizontal orientation, the bases 102 are substantially perpendicular to the supporting surface and the lower side extending ribs 114 function as support feet for supporting the cabinet on an underlying support surface.

Door supporting means, or hinge portions 424 and 425, each having door hinge pin receiving apertures 426 formed therein, protrude outwardly from the leftmost and rightmost ends of front side 104 of the intermediate module 400. By providing two sets of hinges in each intermediate module 400, the assembly can accommodate both mounting orientation of the door 300 at each side 408, 410, depending upon the particular user requirements. When the modular cabinet assembly is vertically oriented on a support surface, the cabinet door 300 is horizontally pivoted open in the conventional manner while pins and pin receiving apertures are vertically oriented. When the cabinet assembly is supported in its horizontal orientation (see FIG. 20), with the hinged end of door 300 rotated 90° toward the supporting surface, the entire cabinet assembly, including the lower support hinges 424, 425 are maintained elevated by the ribs 414 relative to the underlying support surface. In this condition the pins and pin receiving apertures are oriented horizontally. Therefore, in the open position the exterior surface of the door 300, or a limited portion thereof, is supported by the table or other surface upon which the cabinet is positioned.

As previously mentioned, one or more stackable modules 400 are provided interposed between housing end units 100, thereby enabling an end user to readily tailor or customize the holding capacity of the cabinet assembly by merely varying the number of stacked modules 400.

Figure 11:
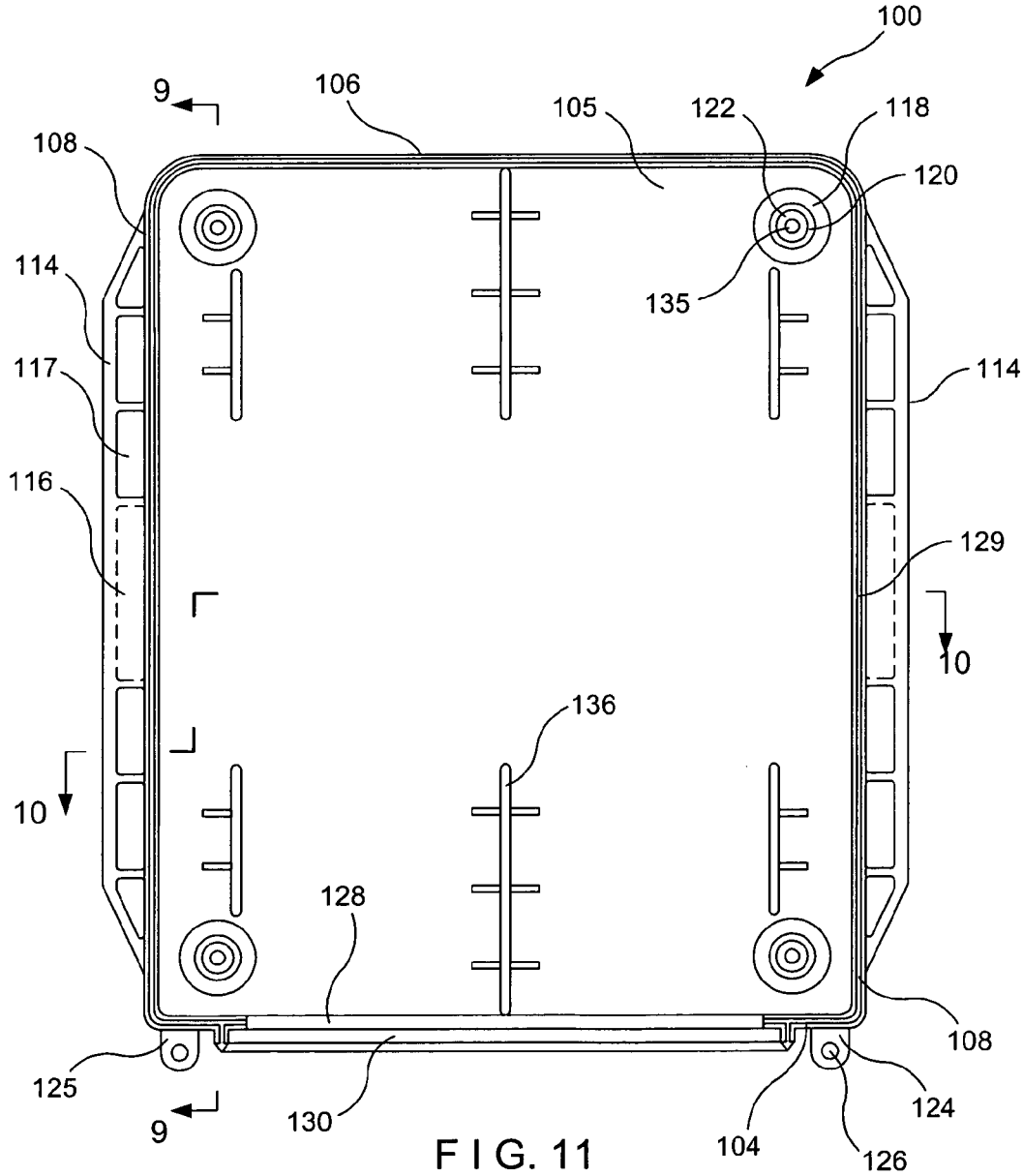
FIG. 11 is a plan view of the interior surface of housing end unit.
Figure 12:
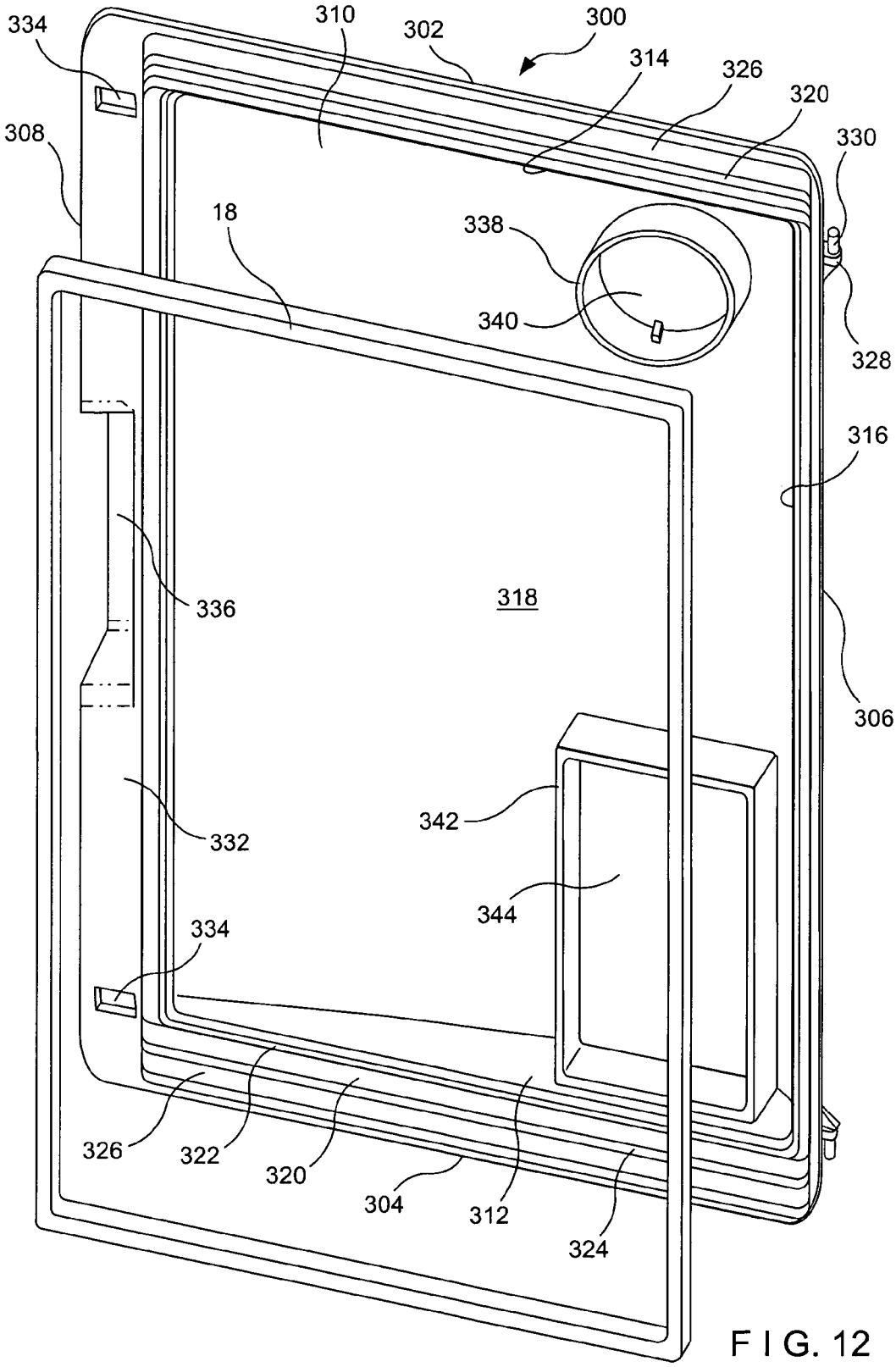
FIG. 12 is an interior perspective view of the front door of the modular cabinet assembly of the present invention, with the front door gasket member shown in exploded view, wherein the front door is depicted having a vertically elongated geometry adapted for use with the four-module assembly of FIG. 1.
Figure 14:
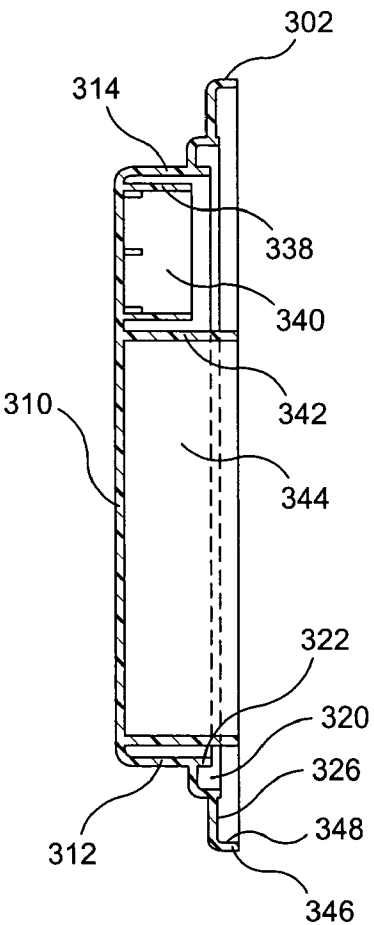
FIG. 14 is a cross-sectional view taken along section plane 14-14 in FIG. 13.
Figure 13:
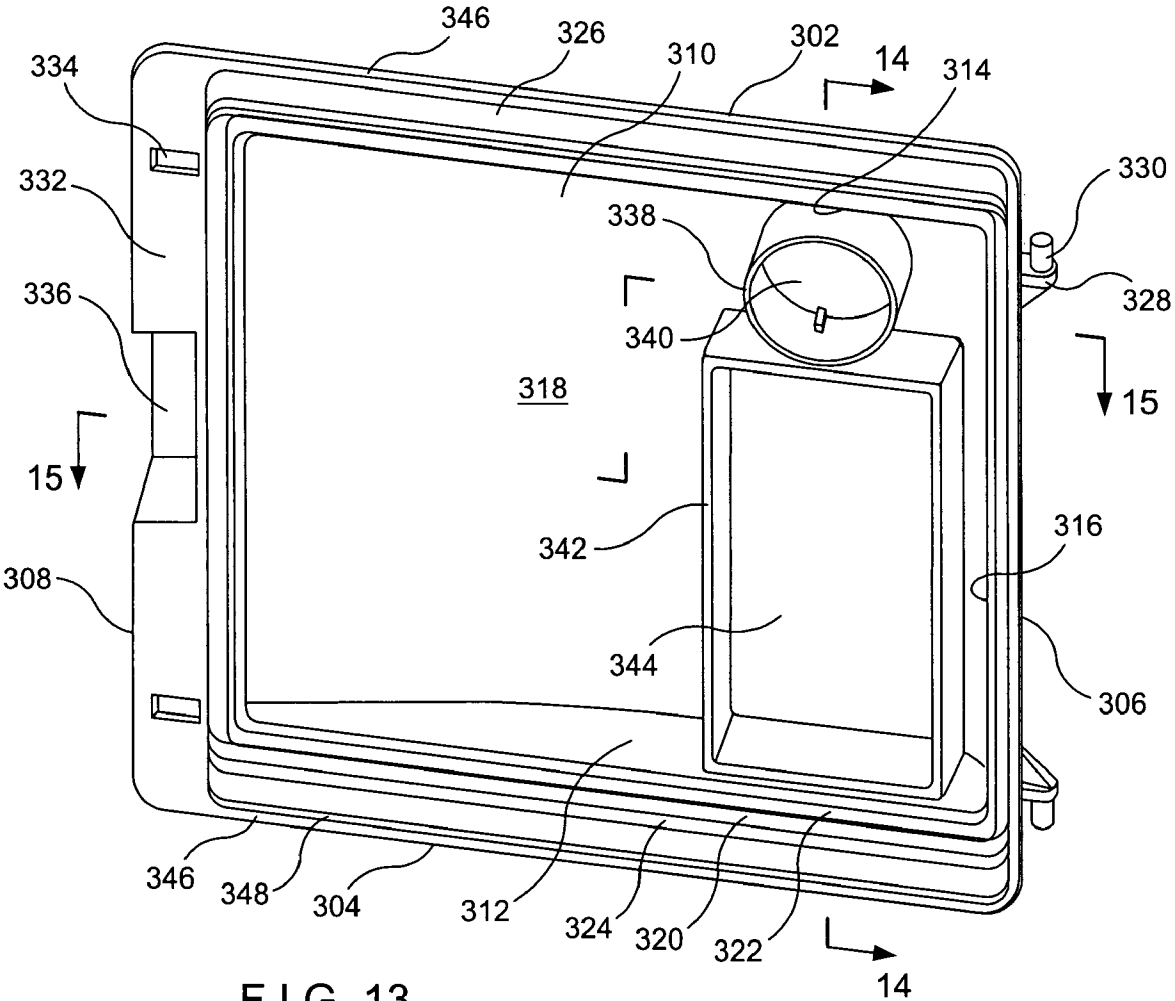
FIG. 13 is an interior perspective view of the front door of the modular cabinet assembly of the present invention, wherein the front door is depicted having a horizontally elongated geometry adapted for use with the two-module cabinet assembly of FIGS. 4 and 16.
Figure 21:
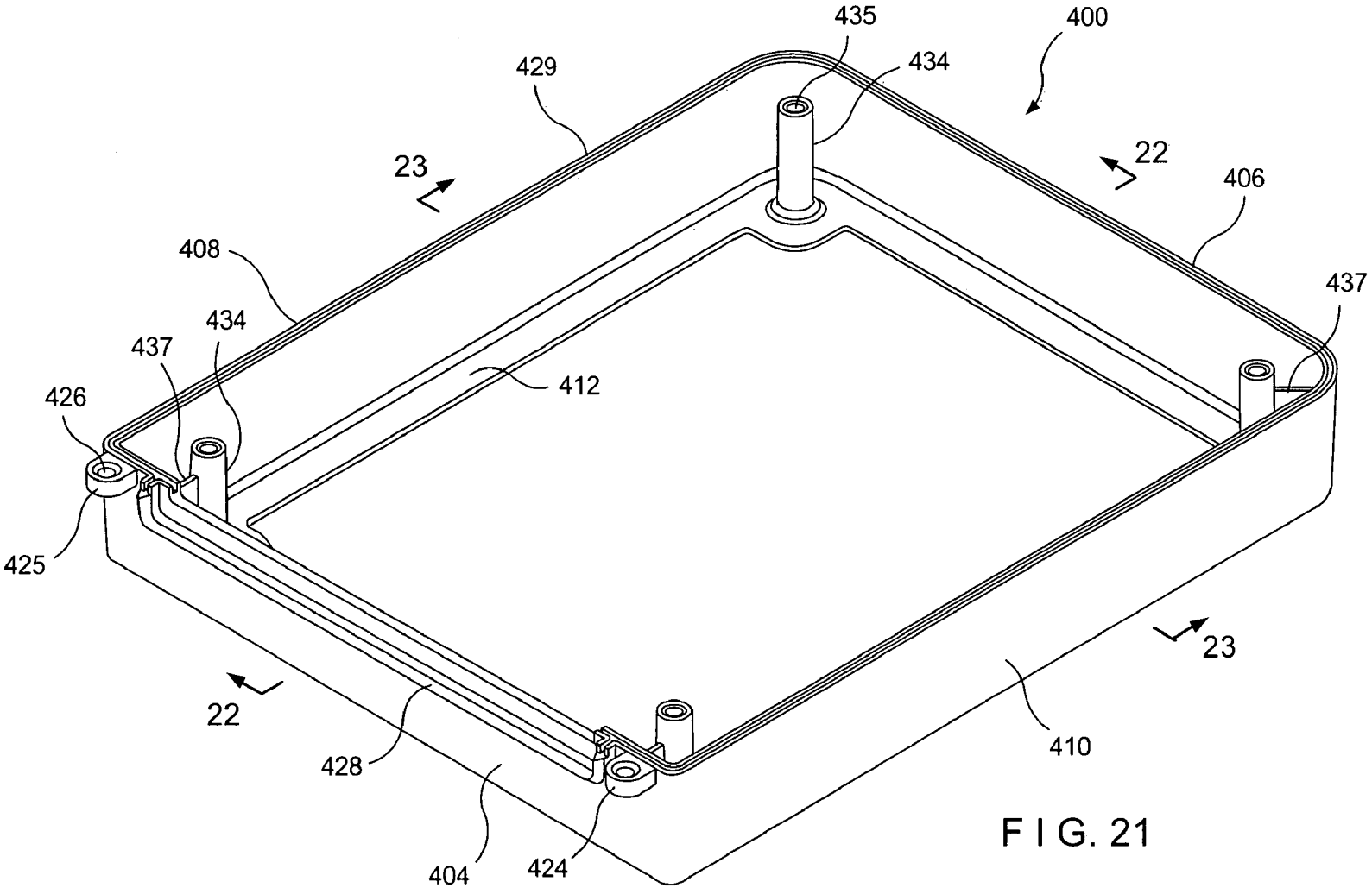
FIG. 21 is a semi-perspective top view of another embodiment of individual base module unit in accordance with the present invention.
Figure 22:
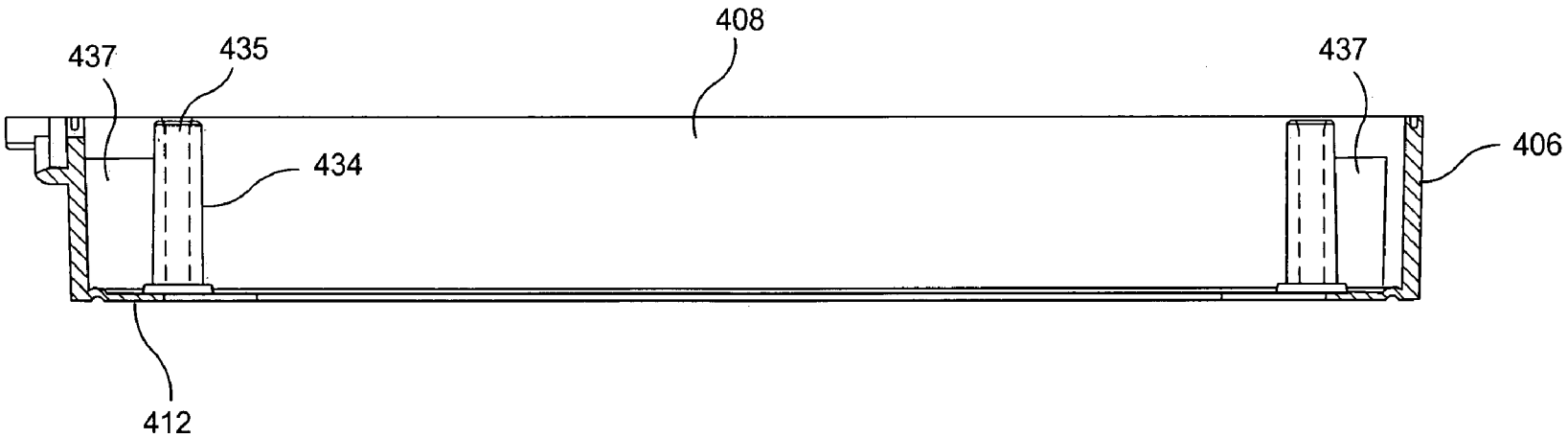
FIG. 22 is a cross-sectional view taken along section plane 22-22 of FIG. 21.
Figure 23:
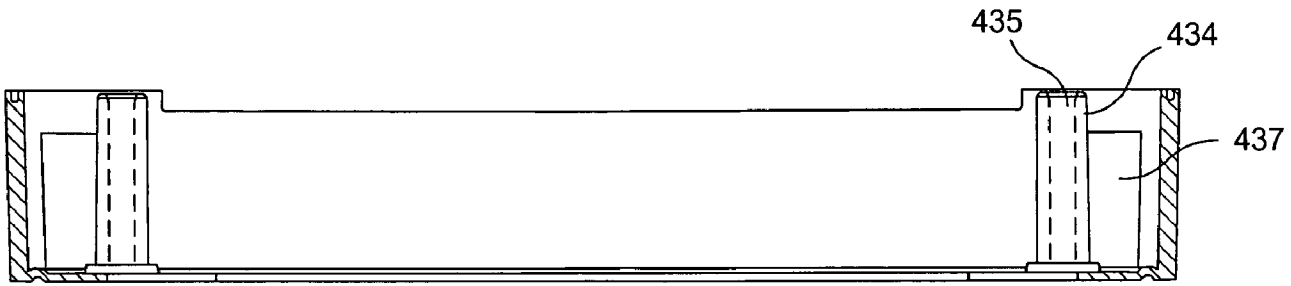
FIG. 23 is a cross-sectional view taken along section plane 23-23 of FIG. 21.
Figure 24:
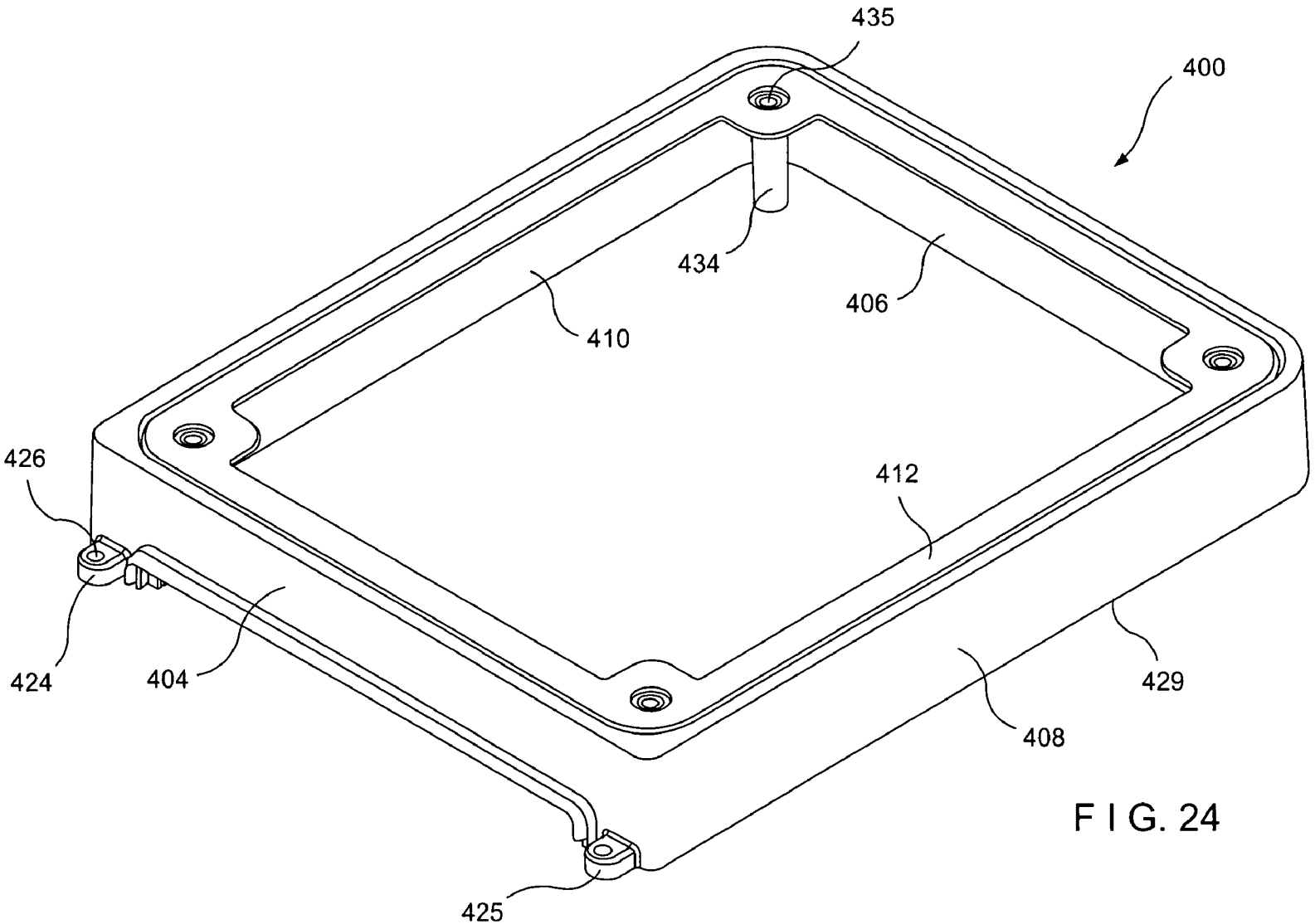
FIG. 24 is a semi-perspective bottom view of the individual base module unit of FIG. 21.
Figure 25:
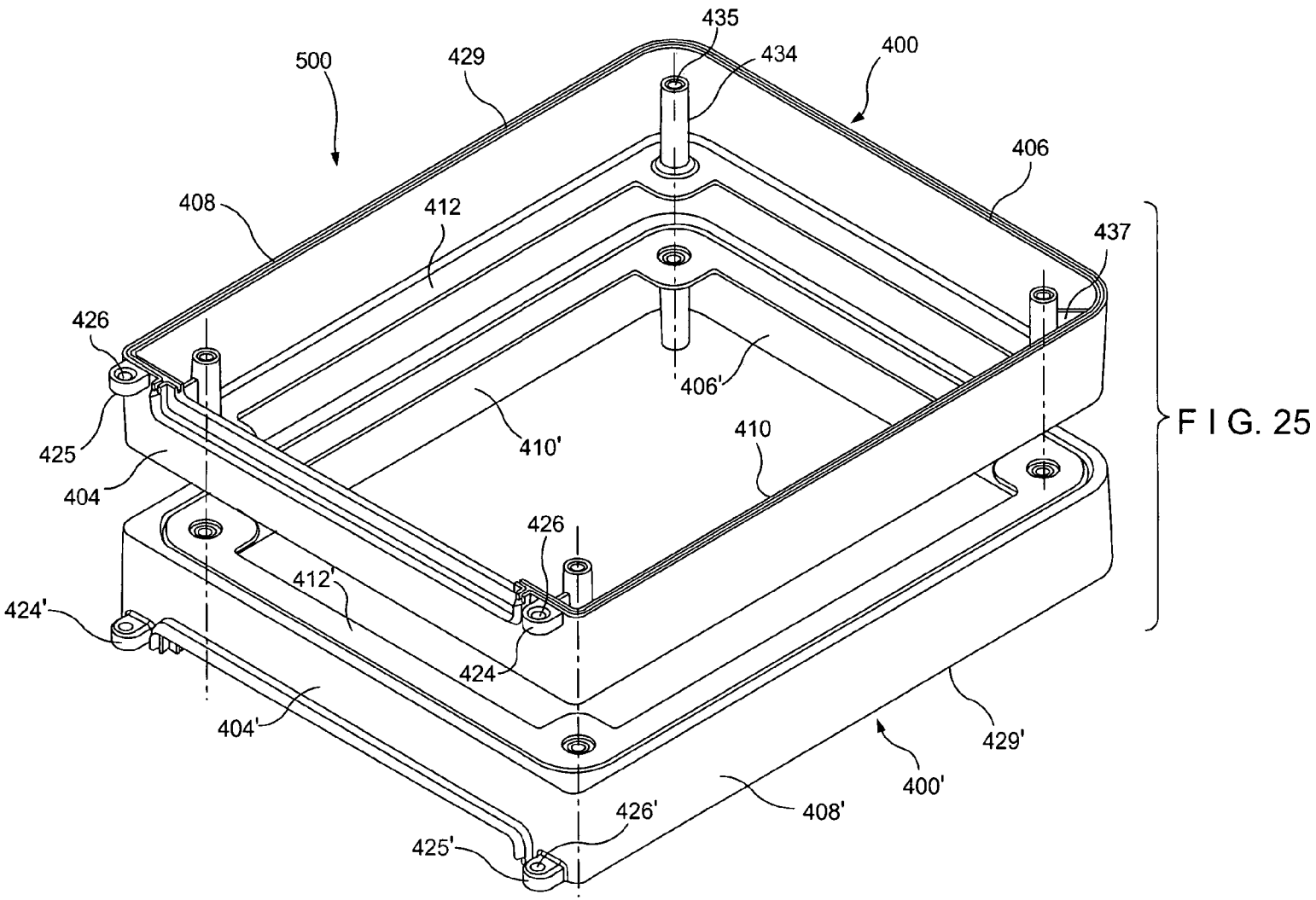
FIG. 25 is an exploded perspective view showing a pair of the base housing module units in an inverted side by side relation to each other.

As best illustrated in FIGS. 21-23 each intermediate module 400 unit has a unitary construction and a generally rectangular geometry defined by rear side 406, first side 408, second side 410 and a front side portion 404 interconnecting the first and second sides. The front side portions 404, rear side 406, first side 208 and second side 210 share a common upper edge 229 and an inwardly extending ledge 212. The inwardly oriented portions of ledge 212 extending along the first side 208 and the second side 210 and further include a depending step 214 adapted for supporting a cabinet shelf 20 (FIG. 1) when the cabinet assembly is substantially vertically oriented. The modular cabinet assembly of the present invention is also adapted for holding shelves in its horizontal orientation. Specifically, as best illustrated in FIG. 11, integral planar supports 136 extend substantially perpendicularly from the interior surface 105 of the upper and lower housing end units 100 for supporting shelves thereon. Shelves 20 may be provided having apertures 22 formed therein.

Unitary, substantially cylindrical columns 234 extend outwardly from the ledge 212 at each corner of the module 400 and are spaced from the inner surfaces thereof. Each column is formed with a guiding channel 235 extending therethrough. In order to stabilize positioning of the columns 234 at the ledge 212 stiffening members 237 are provided. An auxiliary ledge 213 can be formed along the rear side 206.

Figure 19:
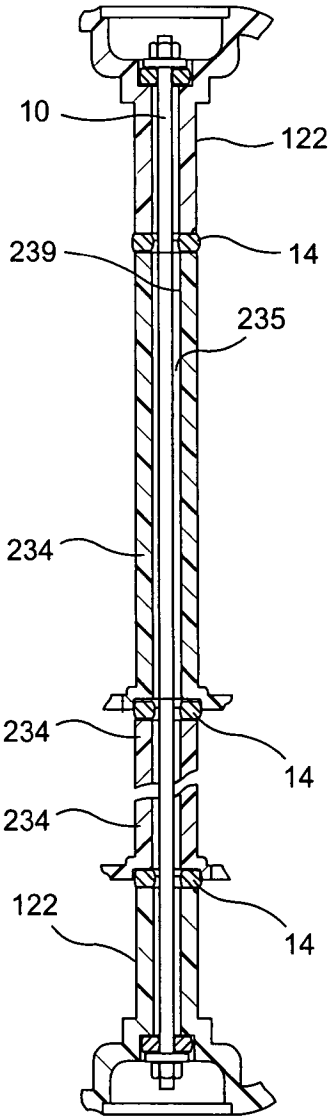
FIG. 19 is a cross-sectional view showing formation of an air-tight passage.
Figure 15:
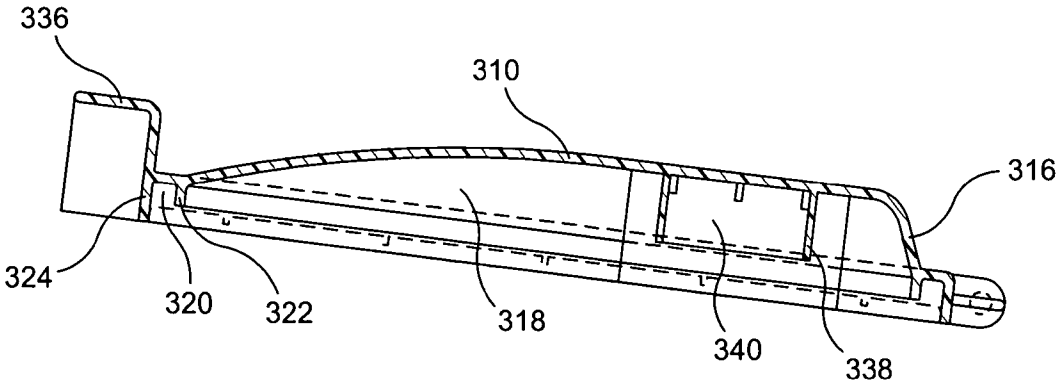
FIG. 15 is a cross-sectional view taken along section plane 15-15 in FIG. 13.
Figure 18:
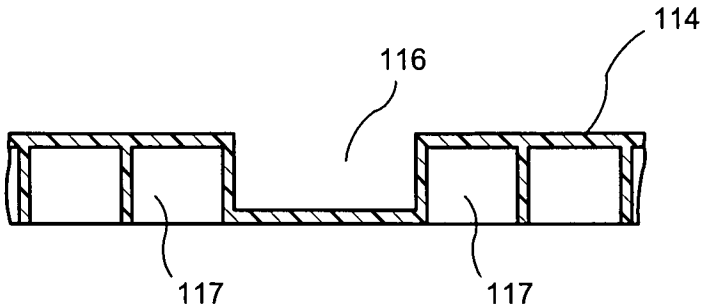
FIG. 18 is a cross-sectional view taken along section plane 18-18 in FIG. 8.
Figure 16:
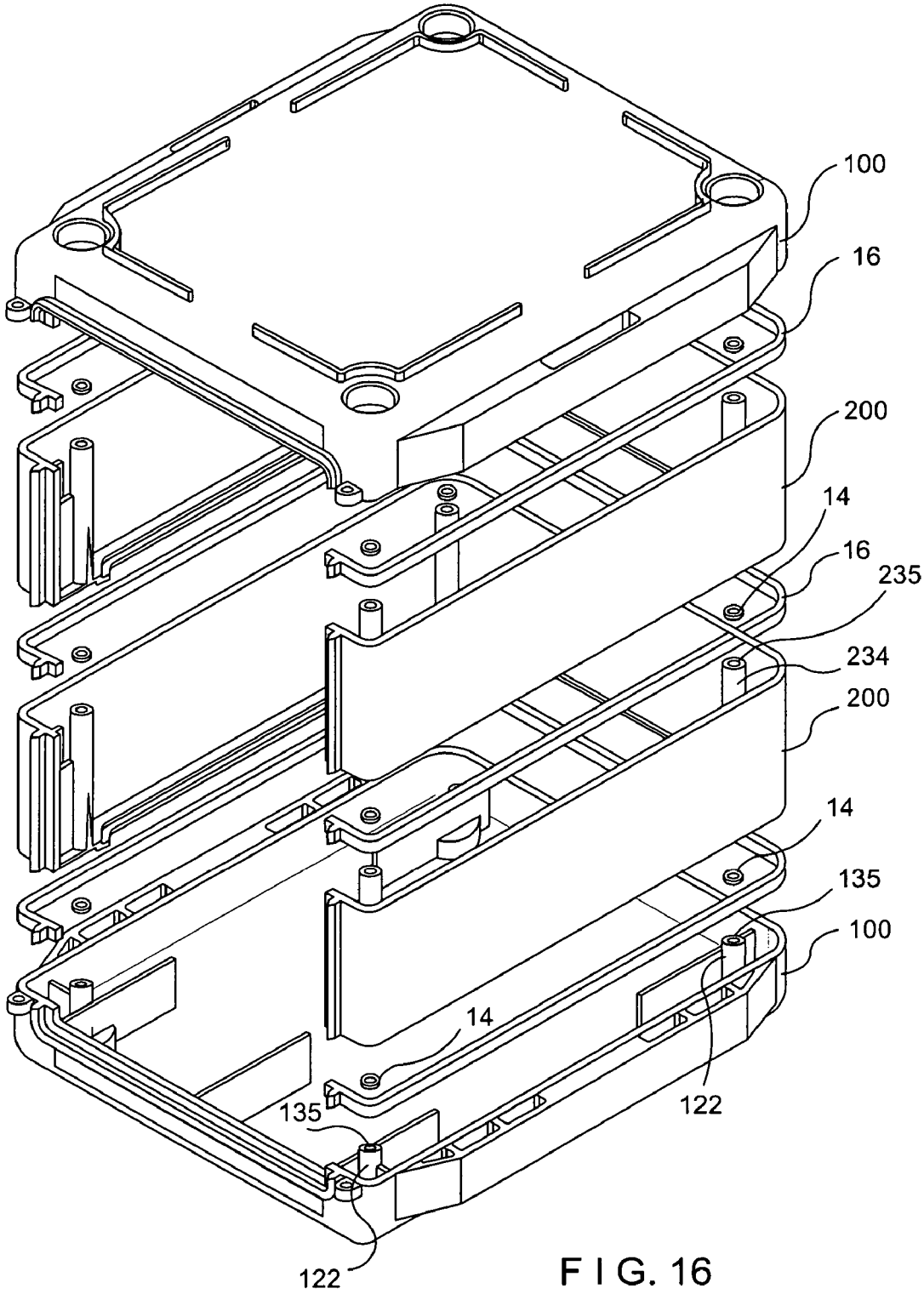
FIG. 16 is an exploded perspective view of the housing subassembly incorporating two intermediate cabinet module of cabinet assembly of FIG. 4 (with the front door removed)
Figure 17:
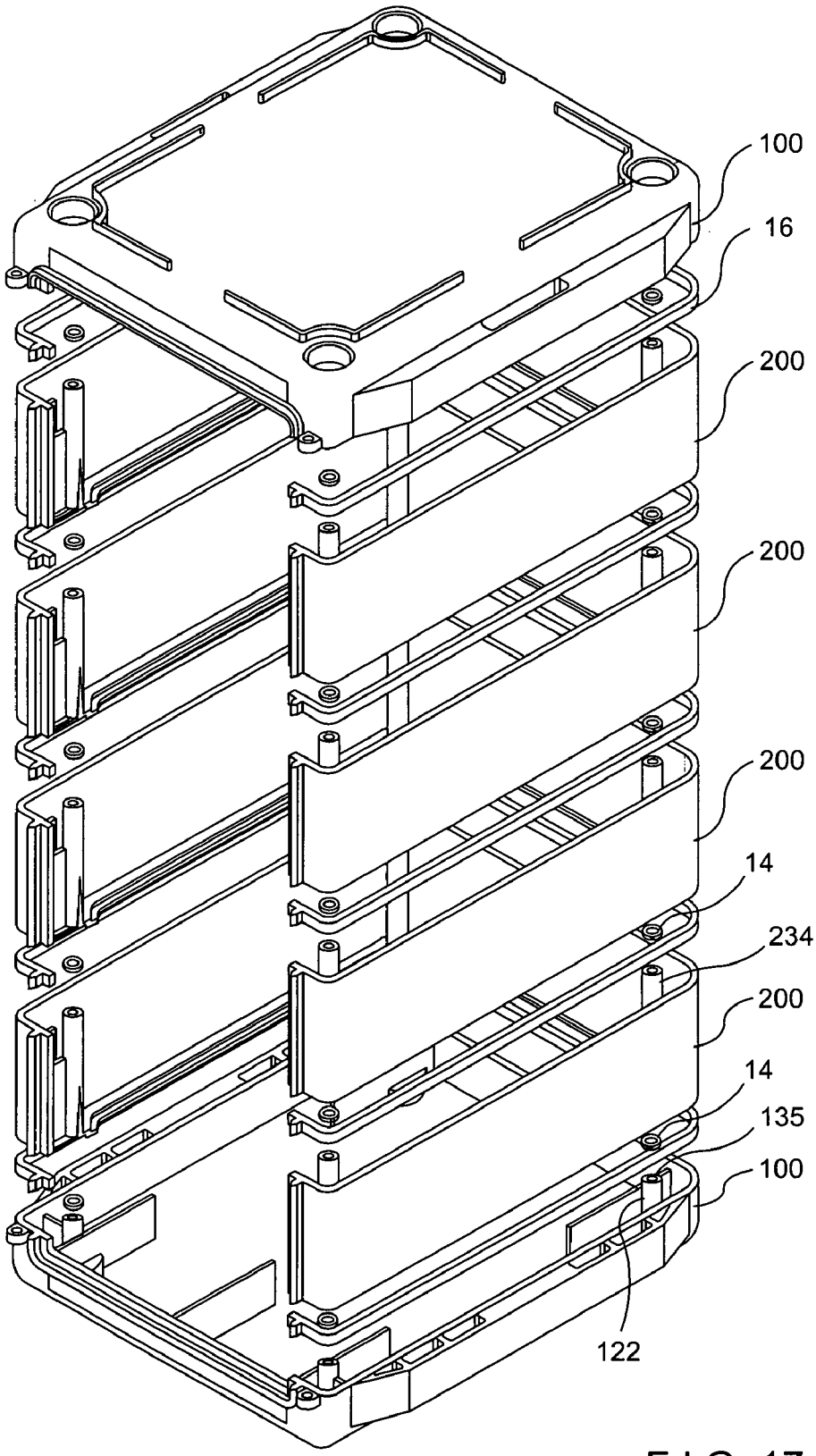
FIG. 17 is an exploded perspective view of a modular cabinet housing subassembly incorporating four intermediate cabinet modules, in accordance with the present invention.

The housing end units 100 and the interposed module(s) 200 are secured to one another using a nominal quantity of fastening components and sealing gaskets to form an airtight housing structure. In the assembled condition of the invention the longitudinal formations or supporting members 122 of the end units are aligned with the respective columns 234 of the module. Therefore, as best illustrated in FIG. 19, at each corner location the guiding apertures 135 and the guiding channels 235 form continuous air-tight passages 239 going through the entire assembly and adapted for receiving and guiding the fastening or connecting members 10. To further improve air-tightness of such passages 239, flexible washers or gaskets 14 can be provided at the areas of engagement between the formations 122 and columns 234. In this manner the interior of the cabinet is further protected from an outside environment especially when the door is closed. The rod or connecting members 10 are adapted to be inserted completely into the passages 239 at each corner of the cabinet. Preferably, the opposite ends of rod members 10 extend at least partially into end unit recesses or cavities 118 and have threaded portions (not shown) for threadably receiving nut members 12. Preferably, nut members 12 are sized for being received within reduced diameter cavity or recess portions 120. Although, the threadable engagement between the fastening components has been described hereinabove, it should be obvious to a person of ordinary skill in the art that any conventional way of engagement and any conventional type of fastening components is within the scope of the invention.

Figure 2:
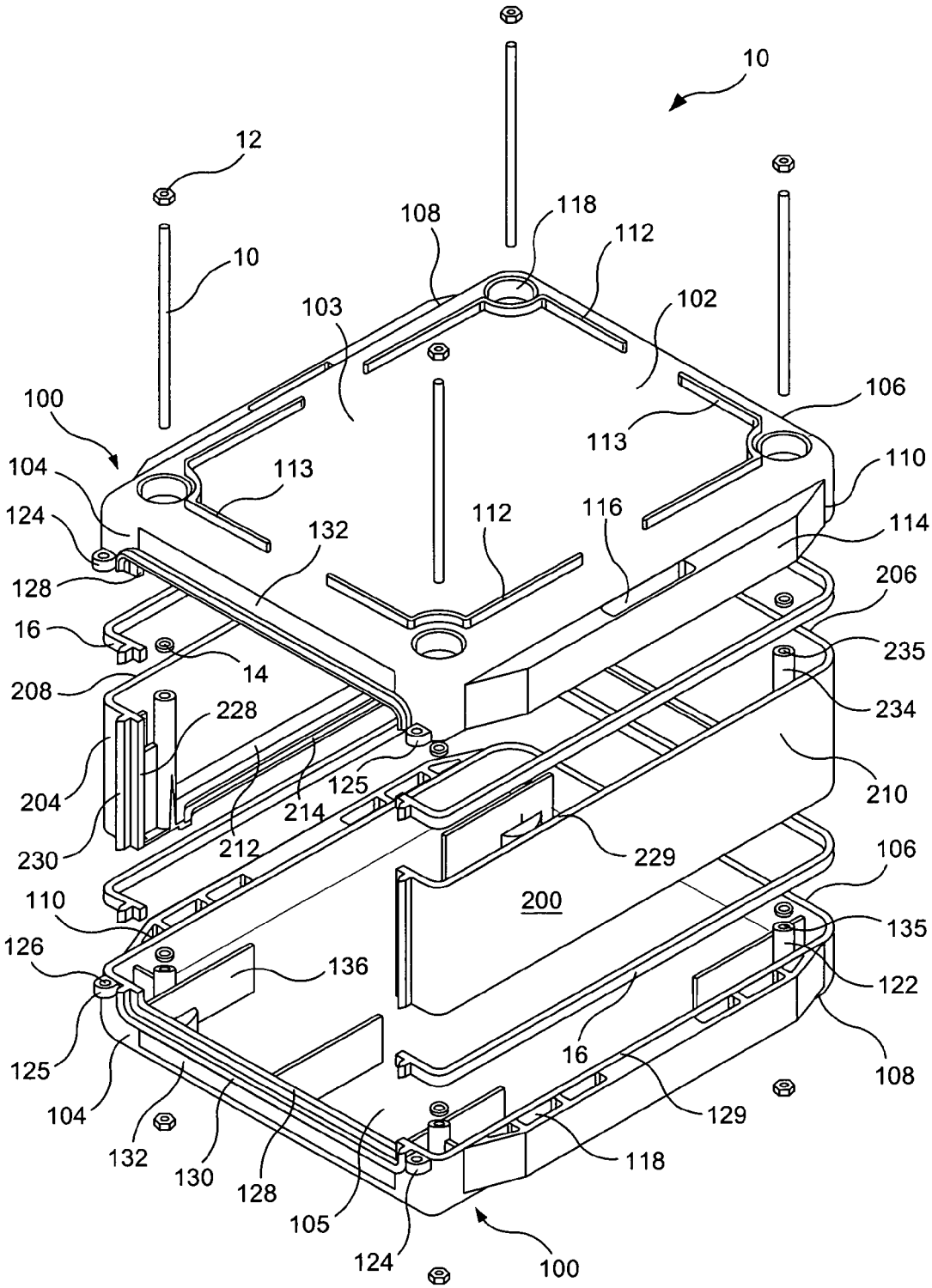
FIG. 2 is an exploded perspective view of a modular cabinet housing subassembly incorporating a single intermediate cabinet module.

As illustrated, for example in FIG. 2, gasket members 16 provide an airtight seal between adjacent housing components. In particular, gasket members 16 are interposed between upper end unit peripheral edge 129 and adjacent module edge 229, and between lower end unit edge 129 and module lower ledge 212. Furthermore, where multiple modules 200 are employed, gasket members 16 are interposed between adjacent module upper edges 229 and lower ledges 212 to provide an airtight seal therebetween. As indicated hereinabove, washer gaskets 14 can be disposed between the abutting ends of supporting members 122 and columns 234, as well as between abutting ends of adjacent columns 234 where multiple modules are employed.

Figure 3:
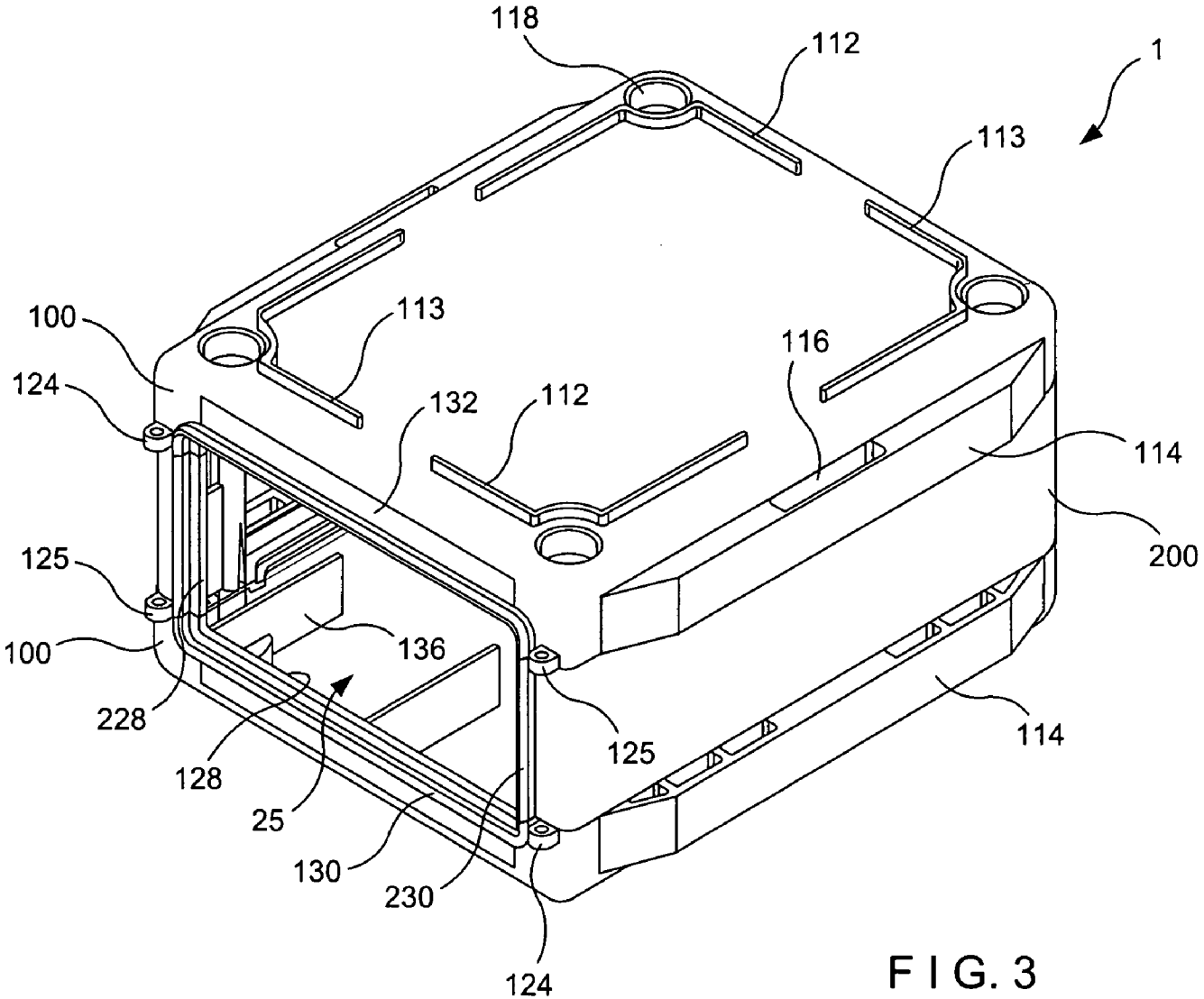
FIG. 3 is a perspective view of the modular cabinet housing subassembly of FIG. 2 in an assembled state.
Figure 4:
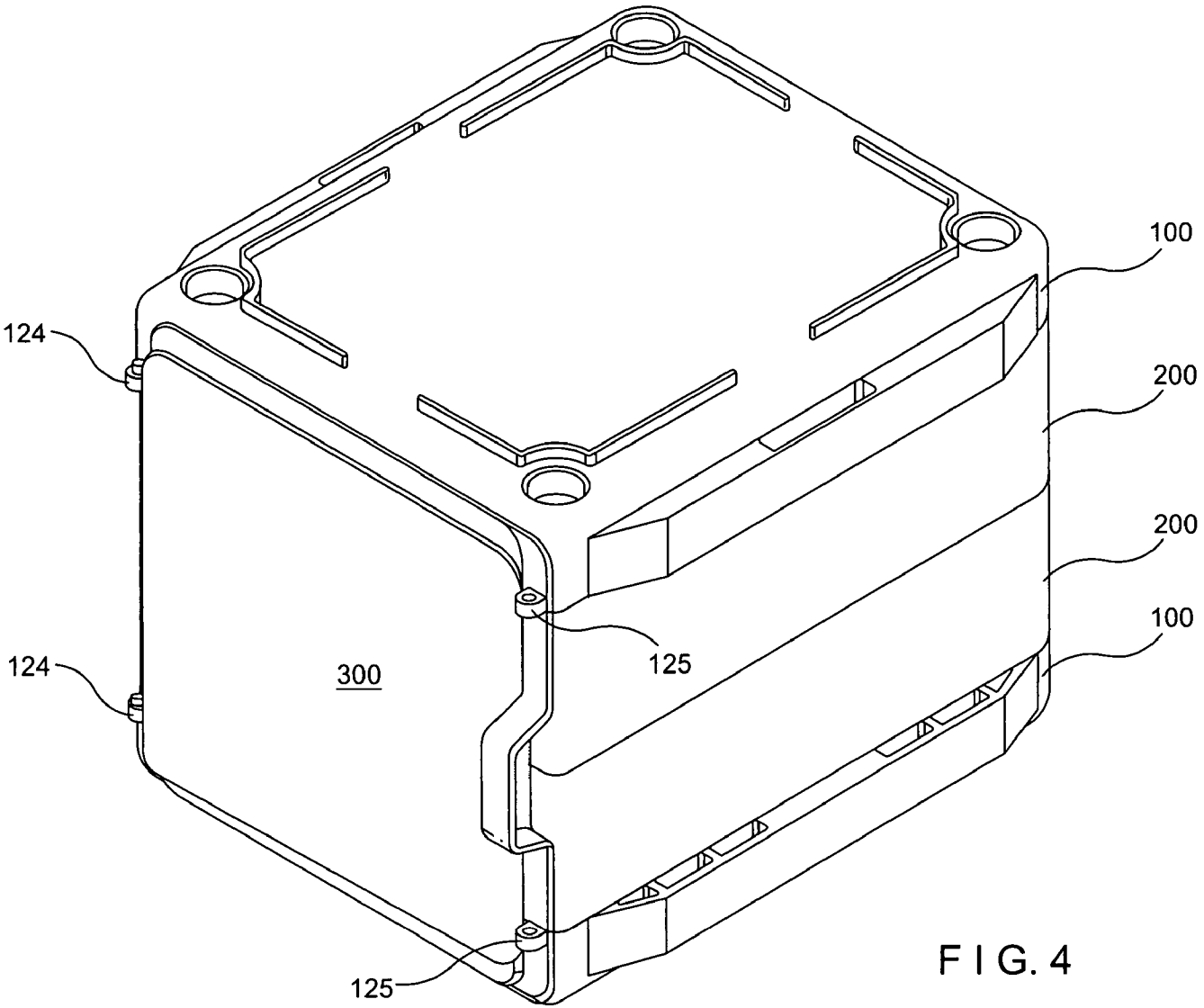
FIG. 4 is a perspective view of a vertically oriented modular cabinet assembly incorporating two intermediate cabinet modules and including a front door portion, in a fully assembled state.
Figure 5:
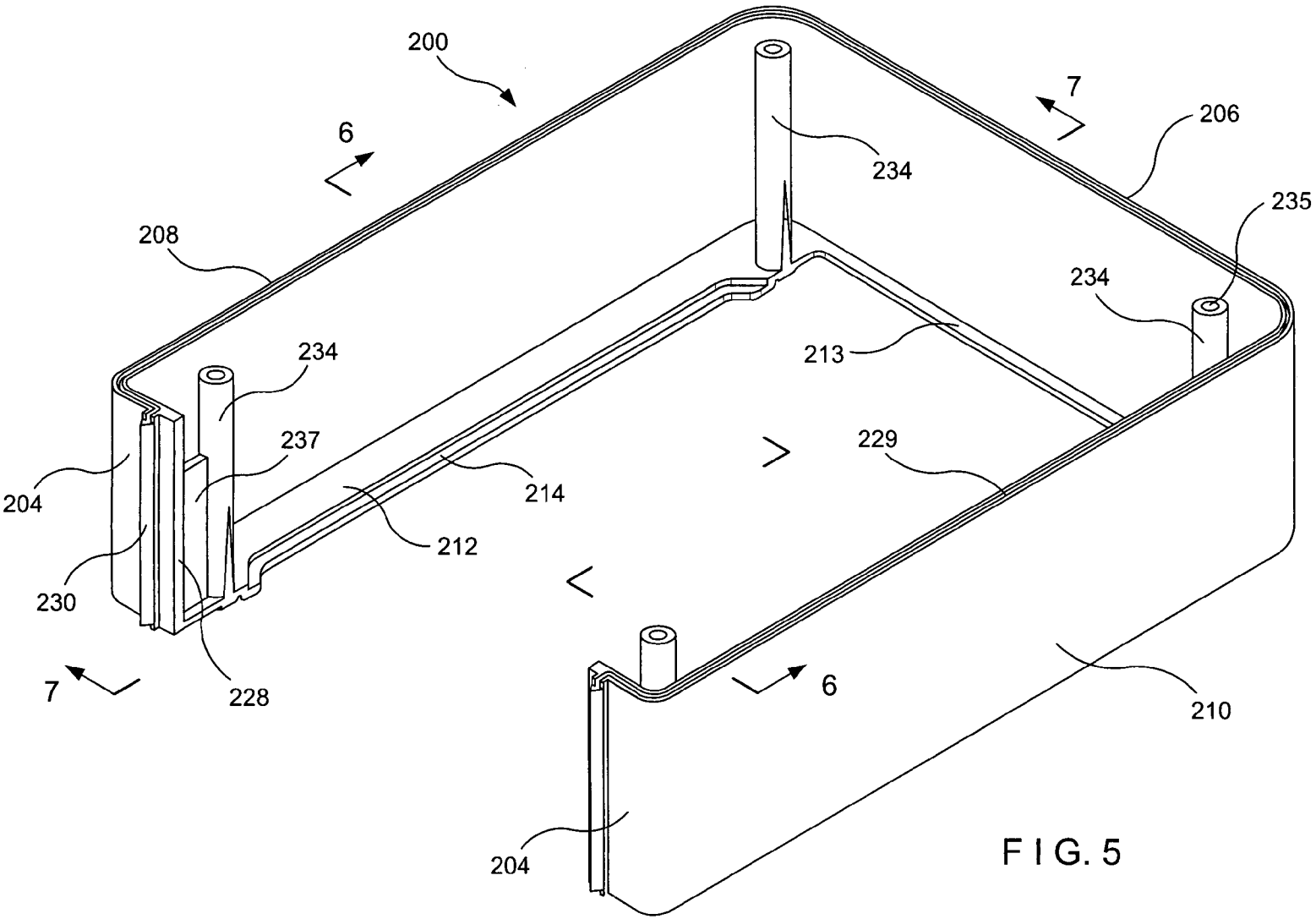
FIG. 5 is a front perspective view of an individual intermediate module unit in accordance with the present invention.
Figure 6:
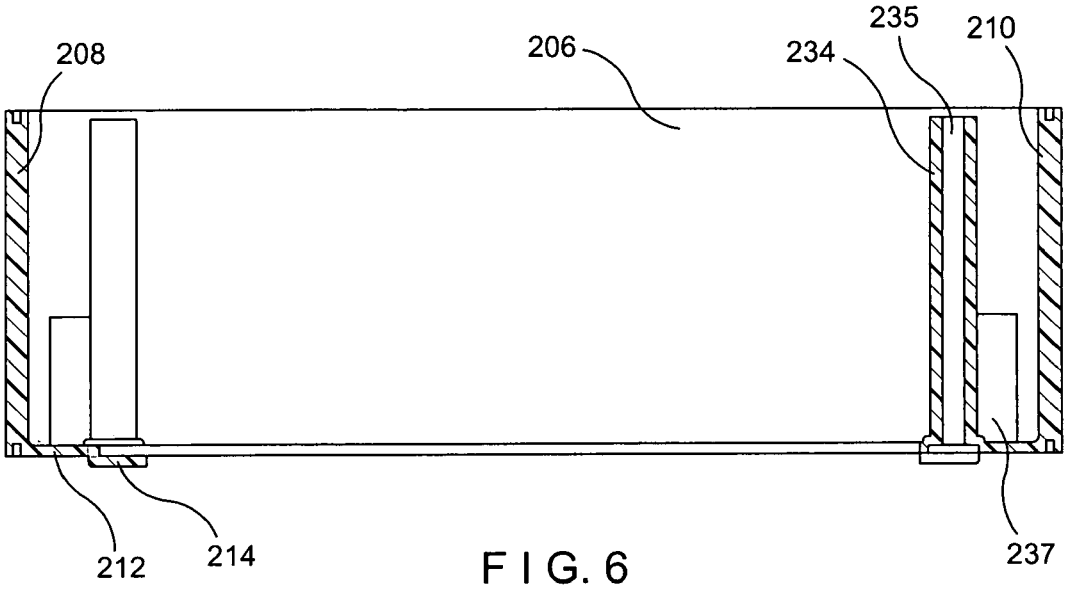
FIG. 6 is a cross-sectional view taken along section plane 6-6 in FIG. 5.
Figure 7:
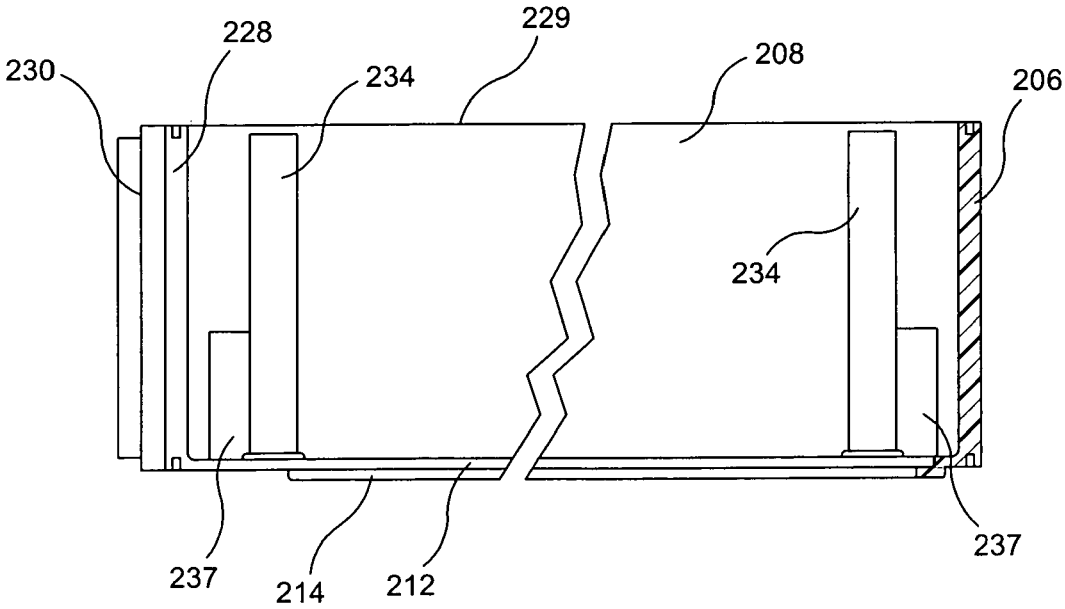
FIG. 7 is a cross-sectional view taken along section plane 7-7 in FIG. 5.
Figure 9:
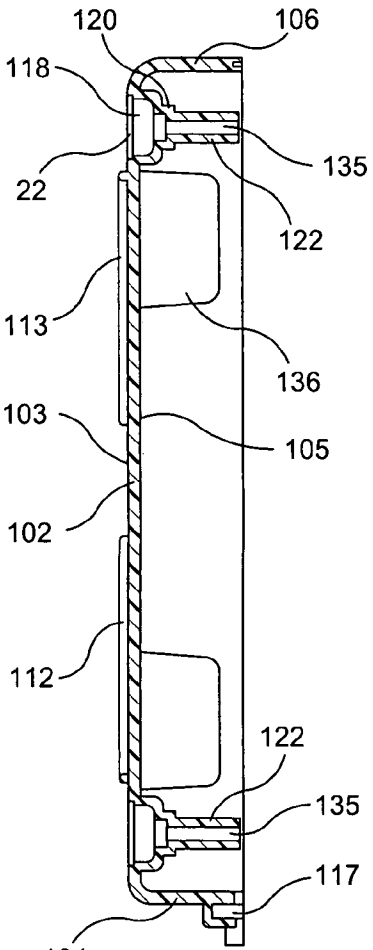
FIG. 9 is a cross-sectional view taken along section plane 9-9 in FIGS. 8 and 11.

With the housing subassembly in an assembled state (see for example FIGS. 2 and 3) recessed edge portions 128 of upper and lower housing end units 100, along with inwardly disposed vertical edge portions 228 of module(s) 200, define a door receiving cabinet housing opening 25 (FIG. 3).

Referring now primarily to FIGS. 12 and 13-15, the structure of cabinet door 300 will be described in further detail. Generally, door 300 is peripherally bounded by upper end 302, lower end 304, hinged side 306 and non-hinged side 308. The door 300 may include a window portion defining an interior window space 318, itself defined by front side 310, lower side 312, upper side 314 and hinged side 316. The significance of the interior window space will now be described.

As should be apparent to those skilled in the art, the modular cabinet assembly of the present invention can be used as a desiccator or dehumidifier. When the cabinet is used as a desiccator, an electronic desiccant control (not shown) is provided to lower relative humidity inside the cabinet. The electrically operated unit circulates air through the enclosed permanent desiccant. Similarly, when the cabinet is used as a dehumidifier, the dehumidifying unit can be provided within the cavity 318 of the door to reduce the humidity of air within the cabinet. The thermal electric cooling module removes moisture from the air and delivers it to a forced evaporation module that exhausts it to the atmosphere. Relative humidity is precisely regulated, and the humidity level should be readable directly through the door window.

Accordingly, in one aspect of the invention, the interior of door 300 is provided with integral structure within window space 318 for holding various devices, products and the like. For example, in one aspect of the invention a circular interior wall 338 defines a space 340 for receiving a humidity measuring apparatus such as a dial hygrometer. Furthermore, at least one additional interior wall 342 defines a space 344 for having mounted therein an electronic desiccating unit, reusable desiccant cartridge or the like. Providing such mounting within the interior surface of door is beneficial in that valuable shelf space is not wasted storing these items. Obviously, variations in the quantity, size, shape and location of the interior mounting structures are possible without departing from the scope of the invention.

A door gasket member 18 (see FIG. 12) is provided sized and shaped for being snugly seated within integral door channel 320 peripherally bounded by vertical surface 324 of interior recess 326 and integral rectangular wall portion 322. When door 400 is closed, gasket member 18 forcibly engages outwardly depending housing structures 130 and 230 to achieve a perimeter door seal.

Integral door hinge pins 330 are provided extending in vertically opposite directions slightly offset from and parallel to door side 306 via hinge support portions 328. Hinge pins 330 are sized and shaped for being received through apertures 126 in housing end unit hinge portions 124 and 125, thereby pivotably supporting cabinet door 300.

Upper and lower interior recessed surfaces 326 can be formed with magnetic closure members (not shown) disposed thereon and positioned for alignment with corresponding magnetic closure members 132 which can be disposed on the outer surface of upper and lower end unit front sides 104 when door 300 is in a closed position.

Non-hinged end 308 generally comprises a flange 332 having an integral door handle portion 336 and upper and lower apertures 334, the apertures sized and shaped for snugly receiving hinge structures 124 and 125 therethrough. In this manner, when door 300 is hingedly mounted via the left set of hinges 124, door apertures 334 engage right hinge structures 125, and vice versa. If desired, a locking pin (not shown), padlock the like can be inserted through one of the unhinged apertures 124, 125.

Door 300 is preferably constructed to be at least partially transparent, or lightly tinted, to allow viewing of dial hygrometer or other instruments mounted against interior surface thereof.

Turning now to FIG. 21-25 illustrating base module unit 400 having a unitary construction and a generally rectangular geometry defined by the rear side 406, first side 408, second side 410 and a front side portion 404. The front side portions 404, rear side 406, first side 408 and second side 410 share a common peripheral edge 429. An inwardly oriented portions of ledge 412 extend along the first side 408, the second side 410 the front side 304 and rear side 306 might include a depending step adapted for supporting a cabinet shelf when the cabinet assembly is substantially vertically oriented. The modular cabinet assembly of the present invention is also adapted for holding shelves in its horizontal orientation.

Unitary, substantially cylindrical columns 434 extend outwardly from the ledge 412 at each corner of the module 400 and are spaced from the inner surfaces thereof. Each column is formed with a guiding channel 435 extending therethrough. In order to reinforce positioning of the columns 434 at the ledge 412 stiffening members 437 can be provided.

Figure 26:
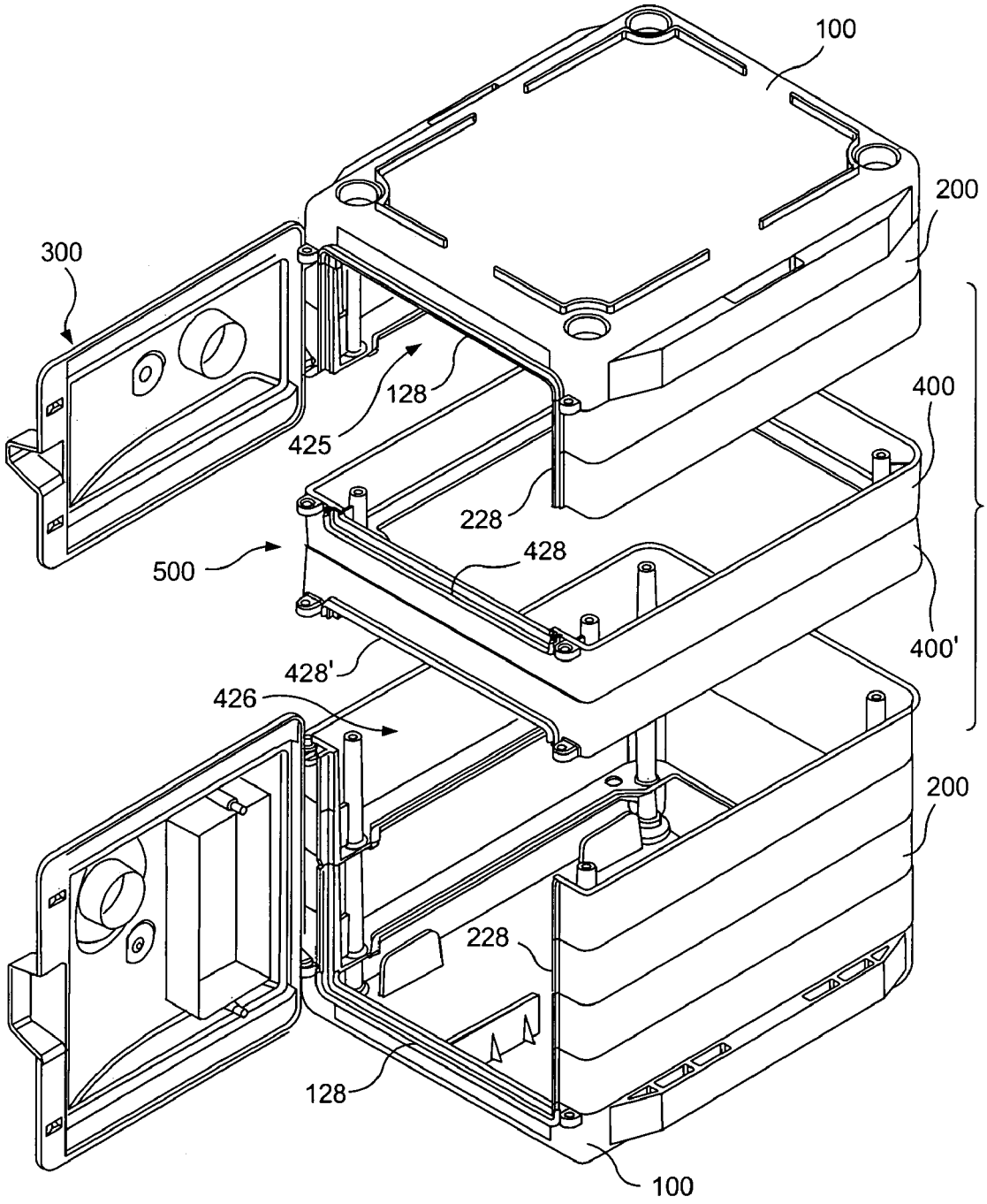
FIG. 26 is an exploded perspective view of the housing assembly incorporating a pair of base module housing units in an inverted side by side position.

The base module unit 400 also includes door supporting means, or hinge portions 424 and 425, each having door hinge pin receiving apertures 426 formed therein, protruding outwardly from the leftmost and rightmost ends of front side 404. By providing two sets of hinges in each base module unit 400, the alternate assembly can accommodate both mounting orientation of the door 300 at each side 408, 410, depending upon the particular user requirements. The front side portion 404 is formed with a recessed edge portion 428. In an assembled state (see FIG. 26), the recessed edge portion 428 of the intermediate module unit 400 along with inwardly disposed vertical edge portions 228 of the respective modules 200 and the recessed edge portion 128 the housing end units 100 define a respective door receiving cabinet housing opening 425.

When the modular cabinet assembly is vertically oriented (see FIG. 26, for example), the cabinet door 300 is pivoted open in the conventional manner while pins and pin receiving apertures 126,426 are vertically oriented. When the cabinet assembly of this embodiment is supported in its horizontal orientation (not shown), with the hinged end of door rotated 90° toward the supporting surface, the entire cabinet assembly, including the lower support hinges are maintained elevated by the respective ribs relative to the underlying support surface. In this condition, the pins and pin receiving apertures are oriented horizontally.

Returning now to FIG. 25 showing an exploded view of an intermediate base formation 500 which is formed by a pair of identical base modular units 400 and 400' adapted to be attached to each other in an inverted position. In this formation, in the first base modular unit 400 includes an upwardly oriented recessed edge portion 428 with the respective hinge portions 424 and 425 situated on both sides thereof. On the other hand, the recessed edge portion 428' of the second base modular unit 400' is downwardly oriented.

In the assembled condition, the intermediate base formation 500 is interposed between a pair of identical opposing housing end units 100. At least one stackable module 200 is interposed between the respective housing end units 100 and the respective base module units 400, 400' of the intermediate base formation 500. The recessed edge portion formation 128 of the top housing end unit 100 along with inwardly disposed longitudinal edge portions 228 of the module(s) 200 and the upwardly oriented recessed edge portion 428 of the first base module unit 400 define an upper door receiving cabinet housing opening 425. In a similar manner, the upwardly oriented recessed edge portion 128 of the lower housing end unit 100 along with inwardly disposed vertical edge portions 228 of the respective modules 200 and the downwardly oriented recessed edge portion 428' of the second base module unit 400' define a lower door receiving cabinet housing opening 426. The housing end unit 100, the intermediate base formation 500 with interposed stackable modules 200 are fastened into the housing assembly by using fastening components, sealing gaskets, etc., such that in the assembled state with the multiple doors 300 in a closed position the cabinet assembly assures an airtight closure.

The housing assembly of FIGS. 21-26 discussed hereinabove further exemplifies modular concept of the cabinet of the present invention adapted to accommodate various requirements of industry. This is achieved primarily because the module cabinet assembly can be custom configured in a relatively simple and efficient manner. In the above discussed embodiment, the module cabinet assembly can be developed not only through utilization of a pair of identical opposing end units 100 and stackable intermediate modules 200, but also through the use of single or multiple intermediate base formations 500 consisting of the pair of identical base modular units 400, 400'. In this manner, the user can provide not only a cabinet having various holding capacities but also build a multi-level structure in which each level is formed with a respective opening adapted to accommodate a respective door.

Although a cabinet housing with one intermediate base formation consisting of one intermediate base formation 500 has been illustrated and discussed, it should be obvious that a cabinet structure incorporating multiple intermediate base formations and capable of forming a structure with multiple doors is within the scope of the invention. As previously mentioned, one or more stackable intermediate modules 200 are provided interposed between the respective housing end unit 100 and the intermediate base formation 500, thereby enabling an end user to readily tailor or customize the holding capacity of the cabinet assembly by merely varying the number of stacked intermediate modules 200.

The modular concept of the laboratory cabinet of the present invention accommodates various requirements of various types of laboratories. Such accommodation is achieved primarily because the modular cabinet assembly can be custom configured at each laboratory in a relatively simple, quick and efficient manner without special skills or special tools. By merely selecting the required number of modules and a specific door associated therewith, the user can provide a cabinet having various holding capacities to accommodate various equipment and products positioned therein. Moreover, the modular concept substantially simplifies shipment, storage and assembly of the laboratory cabinets.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A modular laboratory cabinet assembly, comprising:

a pair of housing end units arranged in an inverted spaced apart relation to each other, each said end unit having a base bounded by front, rear, first and second sides terminating at a common peripheral edge separating interior and exterior surfaces of said end unit, said peripheral edge having a recessed segment extending along said front side;

at least a pair of base housing modules arranged in an inverted side by side relation to each other and interposed between said housing end units, each said base housing module having a rear side, a first side, a second side and a front side portion, said sides portions of the base housing module terminating at an engaging peripheral edge thereof said engaging peripheral edge having a recessed area extending along said front side thereof, and at least one intermediate housing module interposed between each said end unit and the respective base housing module, each said intermediate module is formed with at least a pair of spaced apart from each other front side portions;

each said housing end unit is formed with a plurality of elongated supporting members having guiding apertures passing therethrough, each said base housing module is formed with a plurality of columns each having a longitudinal guiding channel passing therethrough there, and said at least one intermediate housing module is formed with a plurality of columns each having a longitudinal guiding channel passing therethrough;

wherein, said recessed segment of each unitary housing end unit, said spaced apart front side portions of the at least one intermediate housing module and said recessed area of the respective base housing module form a continuous opening.

2. The modular laboratory cabinet assembly as recited in claim 1; wherein said continuous opening is a door opening adapted to accommodate a respective door.

3. The module laboratory cabinet assembly of claim 1, wherein said pair of housing end units comprises first and second unitary housing end units, said recessed segment of said first unitary housing end unit, said recessed area of at least one base housing modular units facing said first unitary housing end unit and spaced apart front side portions of said at least one intermediate housing module interposed between said first housing end unit and said respective base housing module form a first continuous opening; and said recessed segment of said second unitary housing end unit, the recessed area of said base housing module facing said second unitary housing end unit and spaced apart front side portions of said at least one intermediate housing module interposed there between form a second continuous opening.

4. The modular laboratory cabinet assembly of claim 3, wherein said first and second continuous openings are door openings adapted to accommodate respective doors.

5. The modular laboratory cabinet assembly of claim 4, further comprising protrusions having door hinge pin receiving apertures formed therein and positioned at opposite ends of an exterior surface of the front side of each said housing end unit.

6. The modular laboratory cabinet assembly of claim 5, further comprising protrusions having door hinge pin receiving apertures formed therein and positioned at opposite sides of an exterior surface of the front side of each said base housing module.

7. The modular laboratory cabinet assembly of claim 1, wherein the elongated supporting members of the end units are substantially aligned with the respective columns of said at least one intermediate housing module and the respective columns of the respective intermediate housing module, so that the guiding apertures and the guiding channels form a continuous air-tight passages.

8. The modular laboratory cabinet assembly of claim 7, wherein said continuous air-tight passages are adapted to receive connecting members.

9. A modular laboratory cabinet assembly, comprising:

at least a pair of base housing modules arranged in an inverted side by side relations to each other, each said base housing module having a respective rear side, a first side, a second side, and a front side portion, said side portions of the base housing module terminating at an engaging peripheral edge having a recessed area extending along said front side thereof;

a pair of housing end units arranged in an inverted spaced apart relation to each other, each said end unit having a base formed with at least front side thereof provided with a recessed segment;

at least one intermediate housing module interposed between one said housing end unit and the respective base housing module, each said intermediate housing module is formed with at least a pair of spaced apart from each other front side portions; and each said housing end unit is formed with a plurality of elongated supporting members having guiding apertures passing therethrough, each said base housing module is formed with a plurality of columns each having a longitudinal guiding channel passing therethrough, and said at least one intermediate housing module is formed with a plurality of columns each having a longitudinal guiding channel passing therethrough.

10. The modular laboratory cabinet assembly as recited in claim 9, wherein, said recessed segment of each housing end unit, said spaced apart front side portions of the at least one intermediate housing module and said recessed area of the respective base module form a continuous opening.

11. A modular laboratory cabinet assembly as recited in claim 10, wherein said continuous opening is a door opening adapted to accommodate a respective door.

12. The modular laboratory cabinet assembly of claim 11, further comprising protrusions having door hinge pin receiving apertures formed therein and positioned at opposite ends of an exterior surface of the front side of each said housing end unit.

13. The modular laboratory cabinet assembly of claim 12, further comprising protrusions having door hinge pin receiving apertures formed therein and positioned at opposite sides of an exterior surface of the front side of each said base housing module.

14. The modular laboratory cabinet assembly according to claim 13, wherein said respective door is supported by the protrusion formed at the front side of the housing end unit and the protrusion formed at the front side of the respective base housing module.

15. The modular laboratory cabinet assembly according to claim 9, further comprising at least one said intermediate housing module interposed between another said housing end unit and the respective base housing module.

16. The modular laboratory cabinet assembly of claim 9, wherein the elongated supporting members of the end units are substantially aligned with the respective columns of said at least one intermediate housing module and the respective columns of the respective intermediate housing module, so that the guiding apertures and the guiding channels form a continuous air-tight passages.

17. The modular laboratory cabinet assembly of claim 16, wherein said continuous air-tight passages are adapted to receive connecting members.

* * * * *